US006430528B1

(12) United States Patent
Jourjine et al.

(10) Patent No.: US 6,430,528 B1
(45) **Date of Patent: *Aug. 6, 2002**

(54) METHOD AND APPARATUS FOR DEMIXING OF DEGENERATE MIXTURES

(75) Inventors: Alexander Jourjine; Scott T. Rickard; Ozgur Yilmaz, all of Princeton, NJ (US)

(73) Assignee: Siemens Corporate Research, Inc., Princeton, NJ (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/379,200

(22) Filed: Aug. 20, 1999

(51) Int. Cl.[7] ..... G10L 11/00

(52) U.S. Cl. ..... 704/200; 704/233; 375/340

(58) Field of Search ..... 704/205, 200, 704/204, 246, 201, 212, 233; 455/464; 375/21, 340, 223, 320

(56) References Cited

U.S. PATENT DOCUMENTS

| | | | | | |
|---|---|---|---|---|---|
| 4,750,147 | A | * | 6/1988 | Roy et al. | 381/92 |
| 5,263,033 | A | * | 11/1993 | Seshadri | 714/792 |
| 5,465,276 | A | * | 11/1995 | Larsson et al. | 375/346 |
| 5,581,580 | A | * | 12/1996 | Lindbom et al. | 375/340 |
| 5,872,816 | A | * | 2/1999 | Parr et al. | 375/341 |
| 5,905,721 | A | * | 5/1999 | Liu et al. | 370/342 |
| 6,192,134 | B1 | * | 2/2001 | White et al. | 381/92 |

OTHER PUBLICATIONS

"Model of Binaural Localization Resolving Multiple Sources And Spatial Ambiguities", Albani et al., Psychoacoustics, Speech and Hearing Aids, B. Kollmeier, Singapore, 1996, pp. 227–232.

"Using Multiple Cues For Sound Source Separation", Woods et al., Psychoacoustics, Speech and Hearing Aids, B. Kollmeier, Singapore, 1996, pp. 253–258.

"Two Microphone Nonlinear Frequency Domain Beamformer For Hearing Aid Noise . . . ", Lindemann, IEEE ASSP Wkshp on Applns. of Sig. Proc. to Audio & Acoustics, Monhonk, NY, 1995, pp. 1–4.

"Real–time Multiband Dynamic Compression and Noise Reduction for Binaural Hearing Aids", Kollmeier et al., Journal of Rehabilitation Research & Development, vol. 30, No. 1, 1993, pp. 82–94.

"Binaural Noise–Reduction Hearing Aid Scheme with Real–Time Processing in the Frequency Domain", Kollmeier et al., Scand. Audiol., vol. 30, No. 38, 1993, pp. 28–38.

"Speech Processing for Hearing Aids: Noise Reduction Motivated by Models of Binaural Interaction", Wittkop et al., Acta Acustica, vol. 83, Jul./Aug. 1997, pp. 684–699.

"Estimation of Time Delays with Fewer Sensors than Sources", Emile et al., IEEE Transaction on Signal Processing, vol. 46, No. 7, Jul. 1998, pp. 2012–2015.

"Blind Channel Identification and Extraction of More Sources Than Sensors", Comon, SPIE Conference, San Diego, Jul. 19–24, 1998, pp. 2–13.

"ICA Algorithms for 3 Sources and 2 Sensors", De Lathauwer et al., IEEE Sig. Proc. Workshop on Higher–Order Statistics, Jun. 14–16, 1999, Caesarea, Israel, pp. 116–120.

* cited by examiner

*Primary Examiner*—Marsha D. Banks-Harold
*Assistant Examiner*—Daniel Abebe
(74) *Attorney, Agent, or Firm*—
Donald B. Paschburg

(57) ABSTRACT

A method and system for blind channel estimation comprises acquiring two mixtures of at least one at least weakly W-disjoint orthogonal source signal, calculating point-by-point ratios of a transform of a time-window of each of said mixture signals, determining channel parameter estimates from said ratios, constructing a histogram of said channel parameter estimates, repeating the calculating, determining and constructing steps for successive time windows of the mixture signals, and selecting as estimates of said channel parameters those estimates associated with identified peaks on said histogram.

38 Claims, 6 Drawing Sheets

METHOD AND APPARATUS FOR DEMIXING OF DEGENERATE MIXTURES

BACKGROUND OF THE INVENTION

1. Field of the Invention

The present invention relates generally to estimating multiple electrical or acoustic source signals from only mixtures of these signals, and more specifically to obtaining in real-time estimates of the mixing parameters of such signals. Furthermore, in the present invention a demixing (or separation) of a mixture of the signals is accomplished by using estimated mixing parameters to partition a time-frequency representation of one of the mixture signals into estimates of its source signals.

2. Description of the Prior Art

Blind source separation (BSS) is a class of methods that are used extensively in areas where one needs to estimate individual original signals from a linear mixture of the individual signals. One area where these methods are important is in the electromagnetic (EM) domain, such as in wired or wireless communications, where nodes or receiving antennas typically receive a linear mixture of delayed and attenuated EM signals from a plurality of signal sources. A further area where these methods are important is in the acoustic domain where it is desirable to separate one voice or other useful signal being received from background noise being received by one or more receivers, such as microphones in a telephone or hearing aid (where the mixtures of acoustic signals are received by one or more microphones and the mixtures often contain undesirable signals such as other voices or environmental noise). Even further areas of application of BSS techniques of the present invention are in surface acoustic waves processing, signal processing and radar signal processing.

The difficulty in separating the individual original signals from their linear mixtures is that in many practical applications little is known about the original signals or the way they are mixed. An exception, however, is in wireless communications where training sequences of signals known ahead of time are transmitted intermixed with the useful data signals, thereby allowing for transmission channel estimation. These training sequences typically take a large portion of the available channel capacity and therefore this technique is undesirable.

In order to do demixing blindly some assumptions on the statistical nature of signals are typically made. Some solutions to BSS are known in the art for the limited case of instantaneous mixing, i.e., when the signals arrive at the receivers without delay in propagation, and are non-degenerately mixed, that is, when the number of signal emitters is less than or equal to the number of signal receivers. Such solutions are typically cumbersome since they involve computation of statistical quantities of signals that are third or higher order moments of signal probability distributions. The demixing is most often done under the assumption of statistical independence of signals, which implies that all moments of the signals factorize. One useful feature of the present invention is that a considerably weaker assumption on the nature of the signals is used, namely, W-disjoint orthogonality. We assume that our sources are deterministic functions for which the Fourier transform is well defined and that W(t) is a function that is localized in time. Then we call two sources, $s_i(t)$ and $s_k(t)$, W-disjoint orthogonal if the supports of the Fourier transform of the W-windowed sources, denoted $\hat{s}_i^W(\omega,t)$ and $\hat{s}_k^W(\omega,t)$, are disjoint for all t, where, $$\hat{s}_i^W(\omega,t)=\int_{-\infty}^{\infty} W(\tau-t)s_i(\tau)e^{-j\omega\tau}d\tau. \quad (1)$$

In other words, let us denote the support of $\hat{s}_i^W(\omega, t)$ with $\Omega_i$. Then $s_i(t)$ and $s_k(t)$ are W-disjoint orthogonal if, $$\Omega_i \cap \Omega_k = \emptyset \quad (2)$$

Note, the above definition is valid if the Fourier transform of the signals are distributions.

A special case is if we choose W to be constant. Then two functions are W-disjoint orthogonal if their Fourier transforms have disjoint support. In this case, we will call them globally disjoint orthogonal, or simply, disjoint orthogonal. Two time dependent signals $s_i(t)$, $s_k(t)$ are disjoint orthogonal if, $$\int s_i(t)\cdot\bar{s}_k(t+\tau)\cdot dt=0\,\forall\tau i,k=1,\ldots,N.$$

In practice condition (2) does not have to hold exactly. It is sufficient for the present invention if the sources are weakly W-disjoint orthogonal which we is defined formally as, $$|\hat{s}_i^W(\omega,t)|>>1\rightarrow|\hat{s}_k^W(\omega,t)<<1,\forall k\neq i,\forall t,\forall\omega. \quad (3)$$

In order to differentiate (2) from (3), (2) is sometimes referred to as strong W-disjoint orthogonality. While we have used the Fourier transform in (1), it is important to note that any appropriate transform can be used (e.g., wavelet transforms) as long as condition (2) or (3) is satisfied.

It is generally believed in the art that computation of third and higher degree moments is necessary to demix signals in convolutive non-degenerate mixtures. In fact it has been proved by Weinstein et al., in his article entitled "Multichannel Signal Separation by Decorrelation", IEEE Transaction on Speech and Audio Processing, Vol. 1, No. 4, October 1993, that signals cannot be recovered from mixtures of statistically stationary and orthogonal signals for an arbitrary convolutive mixture. One useful feature of the present invention is that it presents a practical method to obviate the restriction in Weinstein et al., and establishes a practical method to demix signals mixtures from convolutive mixtures. In the present invention, the restriction is voided by reducing the class of signals to those that satisfy strong or weak W-disjoint orthogonality and by requiring the mixing of the signals to either have a parametric form or the corresponding mixing filters in convolutive mixing be sufficiently smooth in the frequency domain to allow extrapolation from the set of points on which the support of signals is non-zero. In practice weak W-disjoint orthogonality of signals is very frequently observed, as in the examples of speech and environmental acoustic noise, or can be imposed, such as on the waveform of an emitted EM signal in the case of wireless communications.

Although a number of methods are known in the state of the art for blind demixing of signal mixtures, as noted above most of them use higher order statistics to effect the demixing, such as taught by Bell et al. in their article entitled "An information-maximization approach to blind separation and blind deconvolution", Neural Computation, vol. 7 pp. 1129–1159, 1995. The least computationally intensive methods known in the state of the art use second order statistics. They typically work by simplifying the demixing problem to an optimization problem so that the optimization objective function is a function of signal auto- and cross-correlations such as taught by Weinstein et al. in their forenoted article.

However, even these methods are known to place an exceptional demand on computational resources, especially when there is need for real-time or on-line implementations. A useful feature of the present invention is that the necessary computations involve only first order moments, i.e., the signal values themselves, and no complicated computations of signal statistics is needed. This is particularly advantageous since computation of statistical properties of signals is typically prone to large measurement and estimation errors.

Yet another useful feature of the present invention is that instead of statistical orthogonality most commonly used in second order statistical methods, e.g., as assumed in the forenoted article by Weinstein et al., the present invention uses a deterministic definition of orthogonality. The use of W-disjoint orthogonality condition among other things is advantageous because it is much simpler test than one for statistical orthogonality. To test for statistical orthogonality one needs to create a statistical ensemble of signals with associated probability distributions or, under the additional assumption of signal ergodicity, take an infinite time limit of the integral of the product of two functions. On the other hand, the test for W-disjoint orthogonality involves only computation of one integral or sum for discrete sampled signals, which in practice results in considerable computational savings, since the test is non-statistical in nature.

One method known in the state of the art was presented by Rickard in a talk entitled "Blind Separation of Acoustic Mixtures" presented at Princeton University on May 24, 1999 where it proven that only second order moments of signals are needed to do instantaneous non-degenerate demixing. This method relies on second order statistics but does not translate directly in the domain where the signals are also delayed in arrival. A useful feature of the present invention is that even signals that are delayed can be extracted from their mixtures. A similar method is described in U.S. Ser. No. 60/134,655 entitled Fast Blind Source Separation Based on Delay and Attenuation Compensation filed on May 18, 1999, where only the case was considered where the number of receivers equals the number of emitters. In many practical cases, however, such as in wireless communications, it is desirable to do the demixing when the number of receivers is as small as possible, and in fact is less then the number of transmitters. One advantageous feature of the present invention is that it allows one to use only two receivers to demix received signals with an arbitrary number of mixed sources.

Although instantaneous mixing of signals can be assumed in some applications, in wireless communication applications delays in propagation have to be taken into account. Furthermore, in most applications the number of signal sources and their spatial positions with respect to the receiver is not known before the attempted demixing. Therefore a considerable literature exists concerning estimation of the number of sources and of their direction of arrival (DOA), generally known as channel estimation problem (see for example, B. Van Veen et al., "Beamforming: A Versatile Approach to Spatial Filtering" IEEE ASSP Magazine, April 1988, pp. 4–24). Especially known in the prior art are methods called MUSIC and ESPRIT (see H. Krim et al., "Two Decades of Array Signal Processing Research, The Parametric Approach", IEEE Signal Processing Magazine, July 1996, pp. 67–94). These and all other prior art methods assume that the number of sources is less or equal to the number of receivers. In wireless communications application, for example, this restriction places a fundamental limit on the channel capacity of the communication system, since the number of antennas has to be larger than the number of the users.

A useful feature of the present invention is that it allows one to estimate the number of signal sources even when the number of receivers is less than the number of emitters. In fact with the present invention only two receivers are generically necessary to estimate an arbitrary number of sources from a broad class of signals. Yet another useful feature of the present invention is that no assumption is made that signals are narrow-band, as is frequently done for methods such as MUSIC and ESPRIT. In a number of wireless communications applications, the assumption that signals are narrow-band is not valid and therefore the present invention allows one to estimate signals and channel parameters for wide-band signals as well.

Methods are known in the wireless communications prior art where the number of mixture signals can be less than the number of sources, yet the sources can be demixed (see, for example X. Wang et al., "Blind Multiuser Detection: A Subspace Approach," IEEE Transactions on Information Theory, Vol. 44, No. 2, March 1998). However such methods require that the waveforms be modulated via direct-sequence spread spectrum and that the signature waveforms are already known by the receiver. One advantageous feature of the present invention is that no specific waveform shape is needed for demixing of signal sources, which makes the class of signals that can be demixed considerably larger and hence could lead to increases in the practical information throughput of many communications channels.

In many applications, such as environmental noise reduction, it is important to determine the spatial distribution of signal sources in order to determine where each signal source comes from. One application of the present invention uses a determined spatial distribution for the reduction of environmental noise emanating from machinery containing many moving parts, such as a moving locomotive or a copier. Another application of the present invention is predicting operating failure in such machinery by detecting deviations of the spatial distribution of noise, as compared to its normal distribution. A useful feature of the present invention is that it allows one to perform radiation field mapping, whereby the intensity and spatial distribution of the sources can be determined precisely using only two receivers, provided the sources meet the W-disjoint orthogonality. In one embodiment of the present invention the radiation field is the field of electromagnetic waves, and in another embodiment accomplishes acoustic field mapping.

One method for demixing of time delayed signals was described in the forenoted presentation by Rickard. Although the method, which relies on second order statistics, is less computationally intensive than comparable methods based on higher order statistics, it is still restricted to situations where the number of signal sources is less or equal to the number of the receivers. Furthermore, the method assumes that the number of signal sources is known in advance. One improvement provided by the present invention is that the number of sources for delayed signals can be estimated using mixture values only, without resorting to computation of the signal statistics. This provides a significant speed-up in signal processing.

Yet another complication for blind demixing of signal sources comes about when mixtures contain not only delayed and attenuated signals resulting from direct path propagation from emitters to receivers, but also reflected versions of those signals, which therefore arrive at the receivers with an additional delay and attenuation. Such multipath mixtures are common in wireless and acoustic telephony communications, as well as in hearing aid signal processing applications. To date no method is known in the state of the art that allows one to demix multipath mixtures of signals without using second or higher order moments of the signals. To the contrary it is the current state of the art belief that such demixing is not possible (as noted above in the aforementioned article by Weinstein et al). The present invention embodies a practical method for such demixing and hence represents a considerable advance in the state of the art. In one embodiment of the invention, weakly echoic mixtures can be demixed. In another embodiment multipath mixtures with sufficiently decorrelated echoes can be demixed. In yet another embodiment convolutive mixtures having smooth convolution filters can be demixed.

It is known in art that making assumptions about the class of the signals to be demixed can make demixing of the signals easier. Various models, such as AR or ARMA are used to effect demixing (see L. Parra et al., "Convolutive Source Separation and Signal Modeling with ML", Sarnoff Corporation, Preprint Sep. 5, 1997 and H. Broman et al., "Source Separation: A TITO System Identification Approach", Signal Processing, vol. 73, pp. 169–183, 1999). However these models are very restrictive and do not model real world signals well. It is one advantageous feature of the present invention that the class of signals that allows demixing is much wider and more suitable for modeling acoustic and EM radiation than the AR and ARMA processes.

One example in the prior art where second order statistics of the signals is used for multipath mixtures is in the paper by Parra et al., entitled "Convolutive Blind Source Separation based on Multiple Decorrelation", Sarnoff Corporation, Preprint, undated, published in NNSP-98. However the method presented there relies explicitly on non-stationarity of the signals in order to achieve demixing. Additionally, the method assumes that a large number of potential multipath contributions have to be considered from the beginning. This leads to prohibitively computationally expensive algorithms for demixing. One useful feature of the present invention is that the signals are not assumed to be non-stationary. To the contrary, signal stationarity on a short time scale is required. This reduced requirement leads to implementations of methods that are capable of processing data in real time, since typical time scale data processing can realistically assume the data to be stationary in time. Yet another useful feature of the present invention is that for a broad class of signals, namely for signals for which the autocorrelation function decays sufficiently fast, one does not have to take into account all the multipath contributions. In order to demix, only the components of the mixtures that correspond to the direct path propagation contributions are needed, provided the remaining multipath contributions decorrelate with the direct path contributions. Such decorrelation is often a result of a fast decay of the signals autocorrelation function, which in practice is frequently observed. As a result, a very simple and computationally inexpensive method can be used to demix multipath mixtures. No comparable prior art demixing method for use in the full multipath environment is known.

It is known in the prior art that if only one of the signals in the mixture is non-zero at a given value of signal argument, then demixing is possible (see van Hulle, "Clustering Approach to square and non-square blind source separation", K.U. Leuven, Belgium Preprint Dec. 30, 1998). However the assumption used is that only one signal at a given time is non-zero and that the mixing is instantaneous. However, for demixing in acoustic environments or wireless communication applications, the constraint that the signal of only one source can be non-zero at a given time will often not be valid. Moreover, as the number of signal sources increases, this assumption is even less likely to be satisfied. In wireless communications, this one signal at a time assumption is only true for restrictive signaling schemes, such as time-division multiple access (TDMA), for which demixing is not of interest. The scalar mixing assumption is not true for real acoustic mixtures and is only true for a restrictive class of wireless communications (e.g., indoor wireless). One advantageous feature of the present invention is that the W-disjoint orthogonality condition envelops a much larger class of signals. The vanishing of all but one signal Fourier transform at a given frequency is observed in practice much more often than the vanishing of all but one of the received signals at a given time, in either of the acoustic or wireless communications environments. Yet another advantage of the present invention over the prior art is that the present invention is designed for a more realistic time delay model (i.e., convolutive signal mixing), for which the prior art techniques would not work.

Another known example for demixing mixture signals with less mixture than signal sources is given by Balan et al in his publication entitled "A Particular Case of the Singular Multivariate AR Identification and BSS Problems", 1st International Conference on Independent Component Analysis, Assuis, France, January 1999. However, in this case, only one mixture signal was available for demixing and hence the demixing problem was more difficult than that when two or more mixture signals are available. As a result the method described by Balan et al. utilizes modeling of the signals as AR processes. It is a further advantage of the present invention that it is sufficient to have two receivers in order to not restrict the signal classes to those generated by AR processes.

Yet another example of demixing of signals with fewer received mixture signals than signal sources uses higher order statistics (see the publication by Comon entitled "Blind Channel identification and extraction of more sources than sensors", Eurecom Institute, Preprint, 1998). However the use of higher order statistics leads to excessive computational demands, and in fact this publication states that extension of the demixing method from two mixtures of three signal sources to a higher number of signal sources is computationally unfeasible. It is a further advantageous feature of the present invention that an arbitrary number of signal sources can be demixed using only two mixture signals, provided that the sources are W-disjoint orthogonal and do not occupy same spatial position.

SUMMARY OF THE INVENTION

A method for blind channel estimation, comprising acquiring two mixtures of at least one at least weakly W-disjoint orthogonal source signal, calculating point-by-point ratios of a transform of a time-window of each of said mixture signals, determining channel parameter estimates from said ratios, constructing a histogram of said channel parameter estimates, repeating the calculating, determining and constructing steps for successive time windows of the mixture signals, and selecting as estimates of said channel parameters those estimates associated with identified peaks on said histogram.

A method and apparatus for demixing of at least weakly W-disjoint orthogonal mixture signals, comprising acquiring one or more channel parameter estimates, calculating point-by-point ratios of a transform of a time-window of each of said mixture signals, assigning the value for each point in the transform of a time-window of one of the mixture signals to a first signal source if the estimated channel parameters determined from the ratio are within a given threshold of one of the acquired channel parameter estimates or, if more than one estimate is provided, to the closest of the acquired channel parameter estimates, repeating the above step for each point in the transform in successive time-windows of the mixture signal, reconstructing time domain signals from the assigned values of signals by inverse transforming an accumulation of the assigned values for each signal.

In another aspect of the present invention, a method for voice activity detection is provided comprising the steps of setting a voice activity detection flag on; estimating the number of sources in a sound field map; demixing the sound source of interest; detecting absence of power in said sound source of interest; and setting the voice activity detection flag off.

In yet another aspect of the present invention, said voice activity detection is used in a hearing aid, and said source of interest is speech.

In yet another aspect of the present invention, a method for critical sound activity detection is provided comprising the steps of setting a critical sound activity detector flag off; computing a sound field map; estimating the number of sources in said sound field map; detecting additional sound sources that match one of the critical; sounds in their spectral characteristics; and setting critical sound activity flag on.

In yet another aspect, said critical sound source of interest is voice sound produced for alert in violation of personal safety in a public or private living area.

In yet another aspect, said critical sound source of interest is sound discharged by firearms or other explosive devices in a public or private living area.

DETAILED DESCRIPTION OF THE PREFERRED EMBODIMENT

Figure 1:
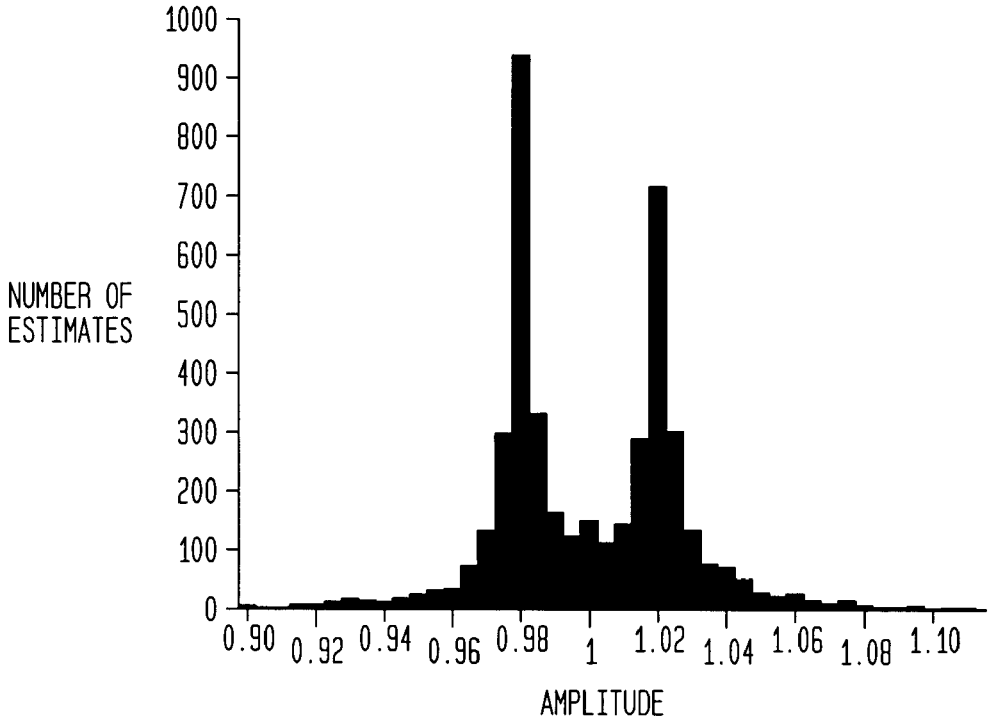
FIGS. 1, 2 and 3 illustrate a histogram of amplitude estimates, a histogram of delay estimates and amplitude/delay clustering for an example of amplitude/delay estimation of two source signals using two microphones.

1. INTRODUCTION INTO MIXING MODELS AND AMPLITUDE/DELAY ESTIMATION IN ACCORDANCE WITH THE INVENTION

Source signals ($s_1(t), \ldots, s_N(t)$) are linearly mixed to form received mixture signals ($x_1(t)$ and $x_2(t)$) as follows, $$x_1(t)=s_1(t)+s_2(t)+\ldots+s_N(t), \tag{4}$$

$$x_2(t)=a_1s_1(t-d_1)+a_2s_2(t-d_2)+\ldots+a_Ns_N(t-d_N), \tag{5}$$

where $a_i$ and $d_i$ are the attenuation and delay mixing parameters, respectively.

Equations (4) and (5) do not describe the case when non W-disjoint orthogonal noise is present, such as Gaussian white noise. However, in practical applications, where the noise power is sufficiently small, the accuracy of the channel estimates described herein will not be effected.

After transforming these mixture signals from the time domain to the time-frequency domain, we can write these equations in matrix form as (for notational simplicity, we use $x_i(\omega, t)$ to denote $\hat{x}_i^W(\omega,t)$), $$\begin{bmatrix} x_1(\omega, t) \\ x_2(\omega, t) \end{bmatrix} = \begin{bmatrix} 1 & 1 & \cdots & 1 \\ a_1e^{-j\omega d_1} & a_2e^{-j\omega d_2} & \cdots & a_Ne^{-j\omega d_N} \end{bmatrix} \begin{bmatrix} \hat{s}_1^W(\omega, t) \\ \hat{s}_2^W(\omega, t) \\ \vdots \\ \hat{s}_N^W(\omega, t) \end{bmatrix}. \tag{6}$$

In the above equations, we have assumed, without loss of generality, that the source signals have been defined, scaled and timed such that the first row of the time-frequency domain model (Eq. 6) consists of all ones. In addition, we have assumed that the windowed Fourier transform of $a_is_i(t-d_i)$ is well approximated by $a_ie^{-j\omega d_i}\hat{s}_i^W(\omega,t)$; this assumption will be valid if the source signal structure does not change significantly during the support period of the window W. In practice, the width of the support of W is chosen such that the assumption is valid (e.g., for acoustic voice signals, the width is on the order of 0.05 seconds). For EM transmission systems, the width can be set based on the specifics of the modulation scheme being employed.

Furthermore, in accordance with the principles of the invention, we assume that the source signals satisfy at least the following weak W-disjoint orthogonality property for sufficient number of ($\omega$, t) pairs, $$|\hat{s}_i^W(\omega,t)|>>1 \rightarrow |\hat{s}_k^W(\omega,t)|<<1 \forall k\neq i, \tag{7}$$

where $\hat{s}_i^W(\omega,t)$ the time-frequency representation of the signal (i.e., the windowed Fourier transform), is defined as, $$\hat{s}_i^W(\omega, t) = \int_{-\infty}^{\infty} W(\tau - t)s_i(\tau)e^{-j\omega\tau}\,d\tau. \tag{8}$$

Other approximations of the exact condition of strong W-disjoint orthogonality as set forth in Eq. (2) can be used in place of Eq. (7).

In practice, W(t) is a simple window function (e.g., a Hamming window) with width T. In other embodiments of the present invention, other signal transforms can be used instead of the Fourier transform in Eq. (8), such as wavelet transforms.

One goal of the present invention is to obtain the original source signals given only the mixtures by use of estimates of the amplitude/delay mixing parameters. Such process is commonly called demixing. In accordance with the principles of the present invention demixing is accomplished by estimating the mixing parameters and then using the estimates to partition the time-frequency representation of one of the mixtures. For sources satisfying the W-disjoint orthogonality property, we note that the ratio of the time-frequency representation of the mixtures is a function of the amplitude/delay mixing parameters for one source only. Stated mathematically, $$x_1(\omega, t) > 0,\ x_2(\omega, t) > 0 \rightarrow \frac{x_1(\omega, t)}{x_2(\omega, t)} = \frac{1}{a_i}e^{j\omega d_1}. \tag{9}$$

Thus, we note that we can obtain an estimate of the amplitude/delay pair, $(a_i, d_i)$, associated with a given signal source via, $$(\hat{a}, \hat{d}) = \left( \left| \frac{x_2(\omega, t)}{x_1(\omega, t)} \right|, \frac{\log\left(\frac{x_1(\omega, t)}{x_2(\omega, t)}\right) - \log\left(\left|\frac{x_1(\omega, t)}{x_2(\omega, t)}\right|\right)}{j\omega} \right), \tag{10}$$

$\forall t, \forall \omega$ such that $|\omega \cdot d_{max}| < \pi$ where $d_{max}$ is the largest possible delay in propagation time between the two received mixture signals. Clustering (forming a histogram of) multiple estimates obtained for various choices of $(\omega, t)$ will reveal the number of sources (i.e., the number of clusters found equals the number of sources) and their respective amplitude/delay mixing parameters (corresponding to a point at or near the center of each cluster, depending upon the echoic nature of the mixtures).

Note that instead of assigning equal weight to all estimates in accordance with a further aspect of the invention a relative weight can be assigned to each estimate which indicates how accurate the estimate is. The relative weight can be assigned based on the information used to generate the estimate and the estimate itself These weights would then be used in the clustering portion of the invention to help determine more accurate cluster centers. For example, estimates corresponding to frequency specific power components having a large power should be assigned more weight that those with low power using the reasoning that low power components may be caused by noise and not by a signal source. Alternatively, rather than weighting estimates based on frequency power, in an alternative embodiment one could simply select, for a given timepoint, the 10 largest frequency powers and gather estimates for these frequencies. This is, in fact, the best mode of the invention at the present time.

Higher frequencies, where $|\omega \cdot d_{max}| > \pi$, can be used to provide multiple estimates per choice of $(\omega, t)$ under the assumption that all delays are equally likely. All d which satisfy (say there are K solutions), $$\frac{1}{\hat{a}} e^{j\omega d} = \frac{x_1(\omega, t)}{x_2(\omega, t)}, \ |d| < d_{\max} \tag{11}$$

should be given weight 1/K in the clustering algorithm. When $|\omega| d_{max} = i\pi + \Delta$ where i is a nonnegative integer and $0 \leqq \Delta < \pi$, then in the case where $|\hat{d}| < \Delta$, there will be i+1 solutions. In the case when $|\hat{d}| \leqq \Delta$, there will be i solutions. Note that the difficulties in dealing with $|\omega \cdot d_{max}| > \pi$ can be avoided by sampling the signal at a sufficiently fast rate, $$r_{samp} \geqq 1/d_{max} \rightarrow |\omega \cdot d_{max}| \leqq \pi. \tag{11a}$$

Figure 2:
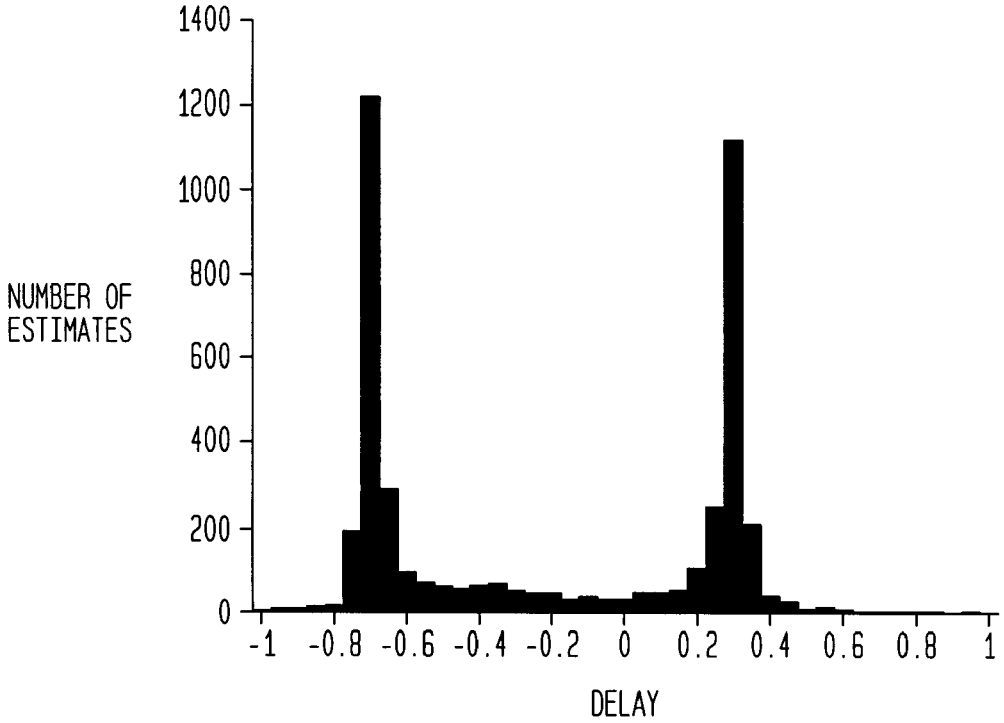
Figure 3:
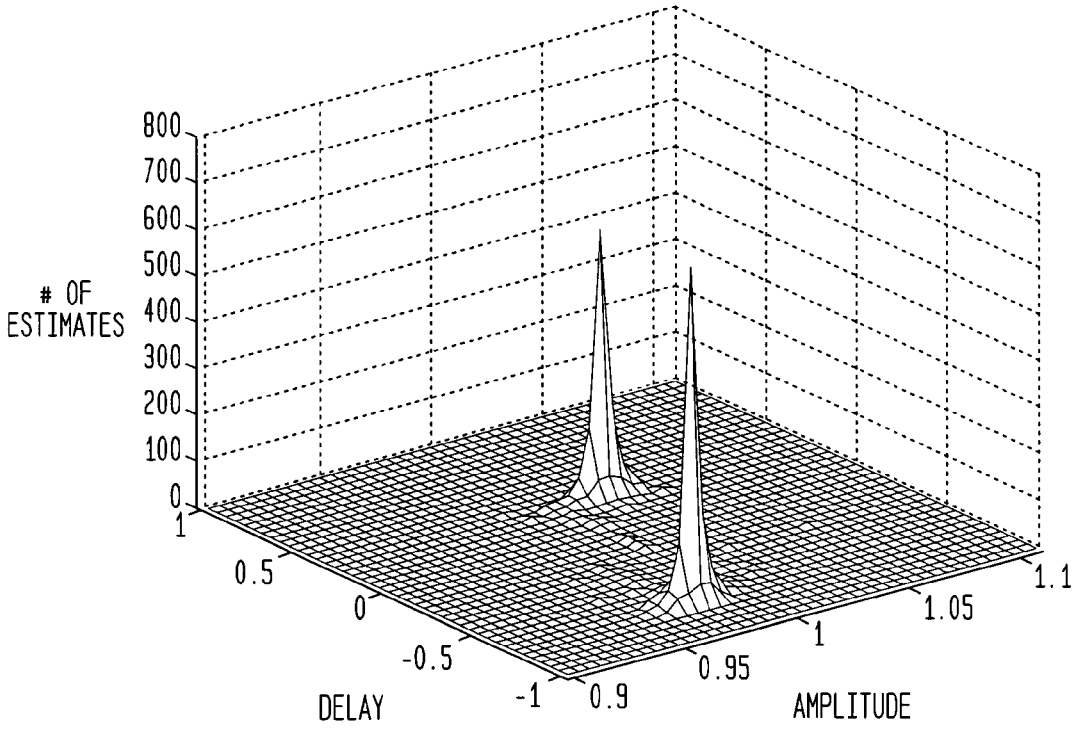
Figure 4:
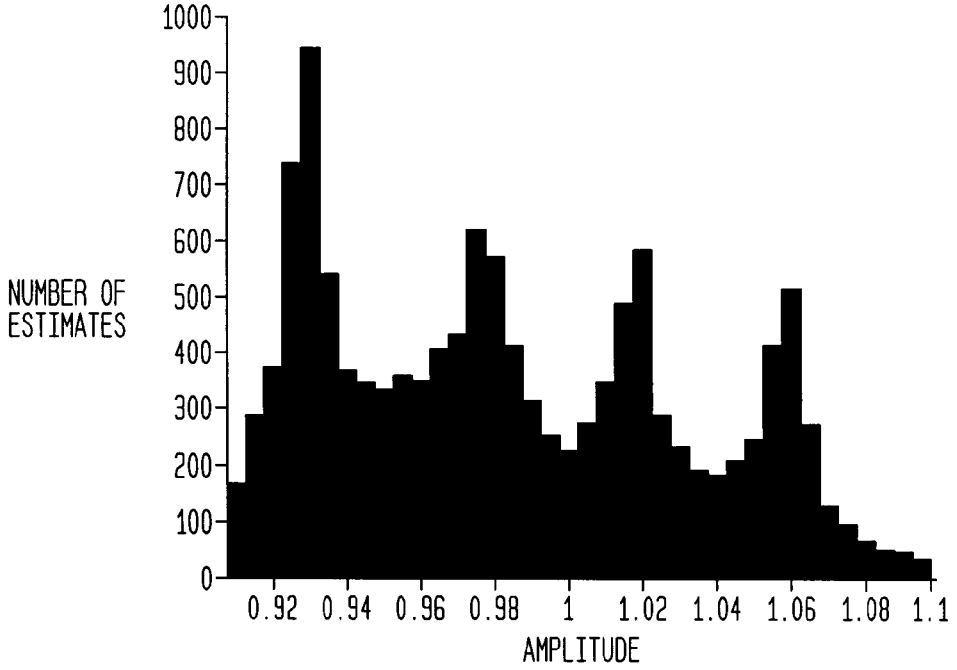
FIGS. 4, 5 and 6 illustrate a histogram of amplitude estimates, a histogram of delay estimates and amplitude/delay clustering for an example of amplitude/delay estimation of five source signals using two microphones.
Figure 5:
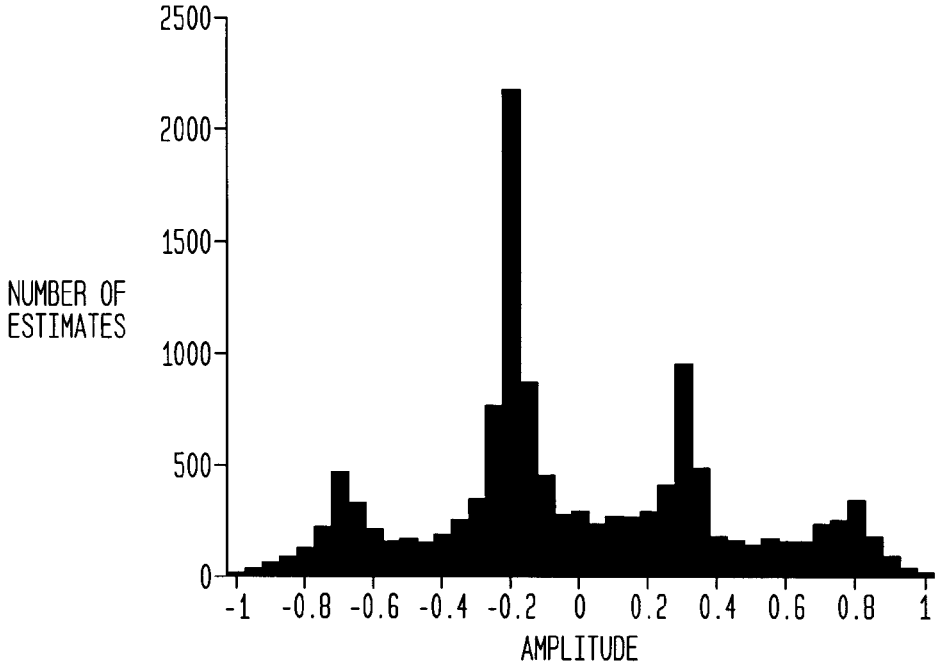
Figure 6:
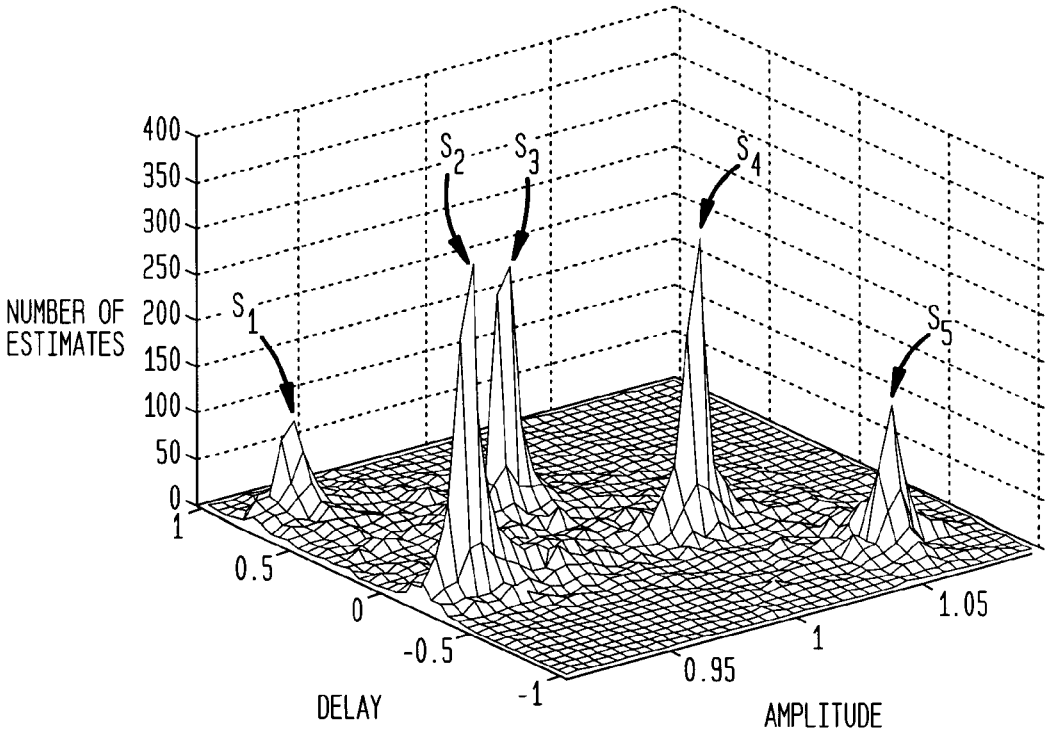
Figure 7:
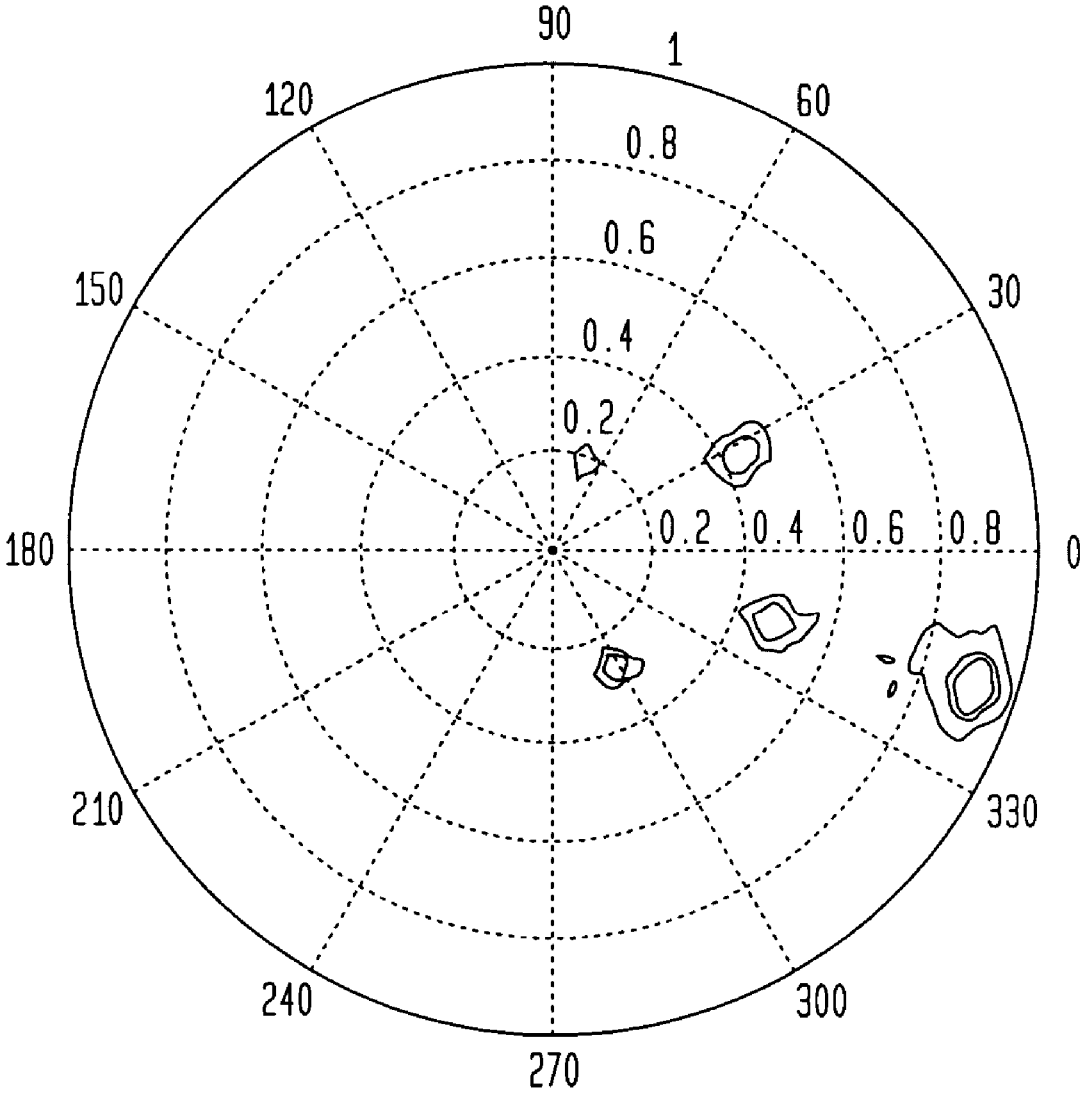
FIG. 7 illustrates clustering of the amplitude/delay estimates onto transformed coordinates so as to provide a radiation field pattern of the estimates.

An example of amplitude/delay mixing parameter estimation of two source signals using two mixtures is shown in FIGS. 1, 2 and 3, where FIG. 1 shows the histogram of the amplitude estimate ($\hat{a}$ of Eq. (10)), FIG. 2 shows the histogram of the delay estimates ($\hat{d}$ of Eq. (10)), and FIG. 3 shows a two dimensional histogram of the results shown in FIGS. 1 and 2. Note that the mixing parameters can be clearly estimated from viewing the peaks in the histograms. Corresponding plots for a five source, two mixture example are illustrated in FIGS. 5, 6, and 7. Note that the technique is able to cluster, and thus demix sources which arrive with the same angle of arrival based on amplitude information. This can be seen in FIG. 6 where two sources ($S_2$ and $S_4$) arrive with the same delay (and thus, the same angle of arrival), yet can be distinguished by their amplitude difference. This same angle of arrival demixing is unprecedented in the state of the art. Note further that in FIG. 6, it is illustrated that sources ($s_i$ and $s_2$) that arrive with the same amplitude estimates can be distinguished by their angle of arrival difference.

FIG. 7 illustrates a radiation field map of the clusters in FIG. 6. The amplitude/delay have been plotted on a polar graph with angle equal to the angle of arrival and radius equal to the normalized amplitude. An amplitude estimate a is normalized as $(a_{max}-a)/(a_{max}-a_{min})$ if the corresponding delay estimate is negative, where $a_{max}$ and $a_{min}$ are the maximum and minimum amplitude estimates. If the delay estimate is positive (meaning that the source is closer to receiver one), the amplitude estimate is normalized as as $(a-a_{min})/(a_{max-amin})$. If we interpret the normalized amplitude estimates as corresponding to the relative differences in distances to each source, this polar graph can be interpreted as a physical mapping of relative source locations. Such a map is useful in environmental noise reduction and industrial machine operation diagnosis.

Demixing is performed by partitioning the time-frequency representation of one of the mixtures (say, $x_1(\omega, t)$) into C channels; each $(\omega, t)$ point is partitioned into a respective channel based on which cluster is closest (and perhaps within a given threshold) to the estimate generated by $x_1(\omega, t)/x_2(\omega, t)$. The thus partitioned and accumulated time-frequency representations can then be transformed back into the time domain to obtain estimates of the original source signals. Alternatively, each of the mixture signals could be partitioned in this way and then the resulting original source estimates combined with the same source estimates from other mixtures synchronized using the delay estimates, to produce higher signal to noise ratio estimates for the original source signals. In the case where noise is present, the assignment of frequency components to demixture channels only when the channel estimates are within a threshold of the estimate generated by $x_1(\omega, t)/x_2(\omega, t)$, results in noise reduction by eliminating all noise components which do not arrive with the correct amplitude/delay.

When more than two mixtures are available, all possible pairings of the mixtures can be used to form estimates of the mixing parameters for each pairing. Then, degenerate demixing can be performed and estimated same source signals from different mixture pairings can be synchronized and combined to produce more accurate estimates for the original sources.

While the system has been designed with the mixing model previously described in mind, it has extensions to the case where multiple paths may exist between transmitter and receiver (i.e., echoes). In the case where the echoes are small in number and amplitude, their presence can be ignored with little effect on the accuracy of the estimates and demixing. On the other hand, if the echoes arrive separated sufficiently in time such that they decorrelate from the direct path (that is, the delay in time associated with the echo is larger than the mainlobe of the autocorrelation function of the source), then the echo will be treated as a separate source and will therefore have its own cluster center and demixture channel. After demixing, the channels can be cross-correlated, pairwise, considering appropriate delays, and the echo channels can be identified and either ignored, or realigned and combined with the direct path to increase the signal to noise ratio of the original source estimate.

In the case where multipath can not be ignored (i.e., convolutive mixing), one can cluster the amplitude/delay channel estimate pairs for each frequency (obtaining multiple estimates for each frequency by considering multiple time windows) and, assuming the convolutive mixing filters are sufficiently smooth, correctly assign the multiple peaks for each frequency to estimate the convolutive mixing filters. These mixing filters can then be used for degenerate demixing.

While the system has been designed with the mixing model previously described in mind, it can be extended to the case where the sources are moving. Moving sources introduce a time rescaling for each source. Rather than estimating static channel parameters, one can calculate the changing channel parameters by constructing multiple amplitude/delay histograms for successive (perhaps overlapping) time periods and tracking the histogram peaks over time. One additional parameter that can be estimated in the case of moving sources is the relative Doppler shift between mixture measurements for each source. This parameter can be estimated by demixing each mixture (rather than demixing only one mixture), synchronizing the same source signal estimates, and estimating the Doppler shift for same source signal estimates.

2. DETAILED DESCRIPTION OF THE PREFERRED EMBODIMENTS

The best mode for implementing the present invention consists of two parts; 1) amplitude/delay estimation and 2) demixing. The first part clusters amplitude/delay estimates, each estimate made by frequency domain analysis of successive small time-windows of the mixture signals which determines both the number of source signals and the corresponding relative amplitudes and delays between them. The second part of the invention uses amplitude/delay estimates to demix the source signals via frequency domain partitioning over small time windows of one of the mixture signals. If the mixture consists of N sources, and N mixture signals are acquired, and the mixing matrix is of full rank, then the amplitude/delay estimates can be used for the mixing matrix inversion demixing, as described in the forenoted U.S. Ser. No. 60/134,655, instead of using the degenerate demixing part of the invention, if desired. Note, although in the preferred embodiment of the invention the estimates determined by the first part of the invention are used in the second part, in general, any technique for determining amplitude and delay estimates for each frequency component associated of the mixture signal could be used in the demixing part of the invention.

Amplitude/Delay Estimation

Figure 8:
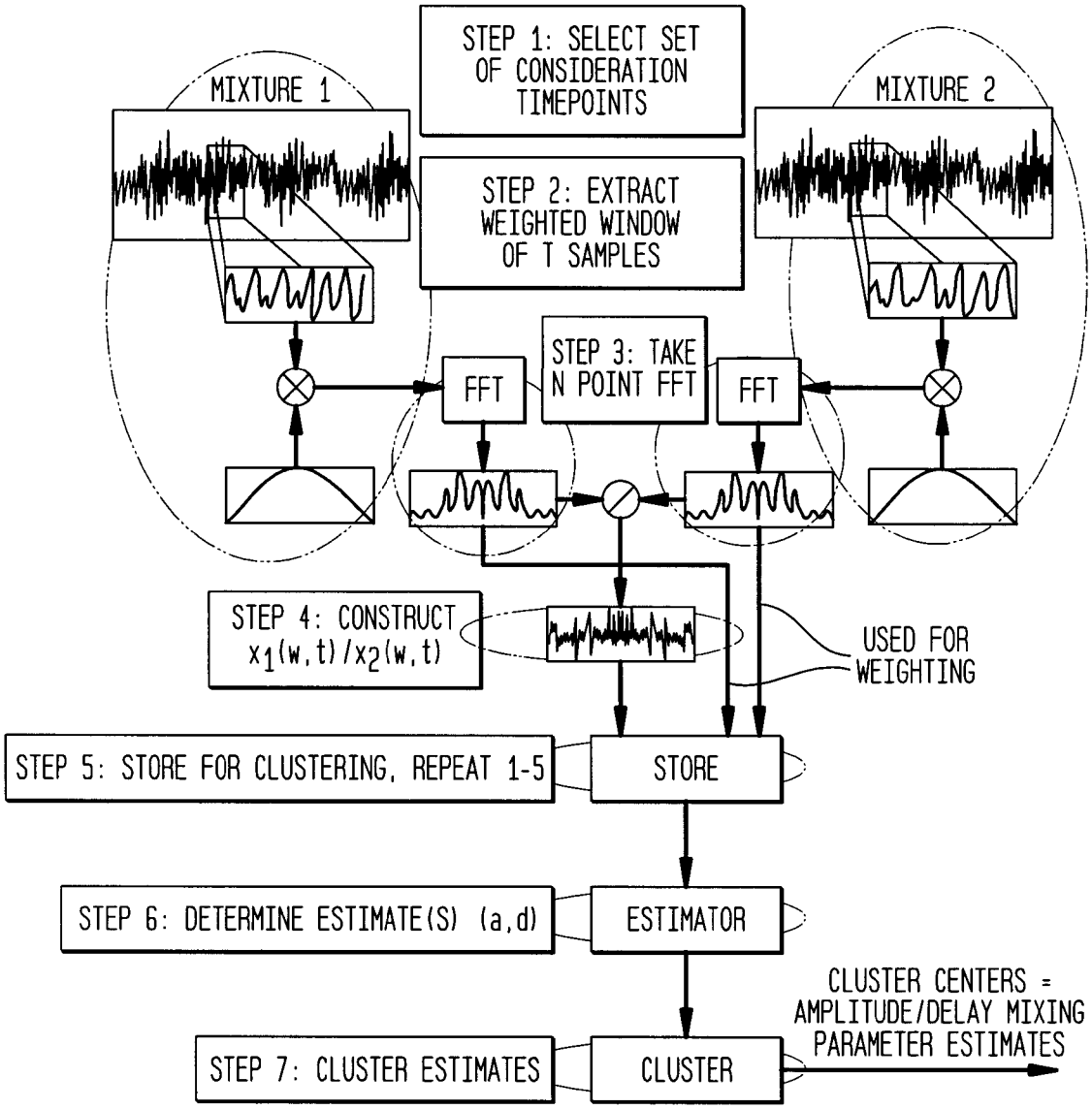
FIG. 8 illustrates a method and apparatus for amplitude/delay estimation in accordance with the principles of the present invention.

In accordance with the principles of the present invention, amplitude/delay estimates are obtained by taking the fast Fourier transform (FFT) of a weighted window of two received mixture signals $x_1(\omega,t)$ and $x_2(\omega,t)$ and dividing the resulting frequency domain vectors point by point. This corresponds to the first portion of equation (10). Further division of the FFT ratio by the corresponding frequency multiplied by the imaginary unit, yields the amplitude/delay estimates. This corresponds to the second portion of equation (10). Each such estimate is assigned a weight based on its value, the $\omega$ used for its generation, the value of $x_1(\omega, t)/x_2(\omega, t)$, and the value of $|x_1(\omega, t)|$. The weighted estimates are then clustered; the number of resulting clusters being the number of sources and the cluster centers being close to the actual values of the amplitudes/delays. A more detailed description follows where each step described below is shown in FIG. 8:

1. Select a set of time indices to use as starting points for the windowed amplitude/delay estimation.
2. For each time index, extract a weighted (e.g., Hamming) window of T samples from each of two acquired mixture signals.
3. Take an N point FFT of both windowed mixture signals.
4. Divide the N FFT components of the first mixture signal by the corresponding FFT components of the second mixture signal; call the resulting vector the $x_1(\omega, t)/x_2(\omega, t)$ vector.
5. Store the $x_1(\omega, t)/x_2(\omega, t)$ vector (which contains all the information for calculating the amplitude/delay estimates) along with the frequency specific power vector ($|x_1(\omega, t)|$) (which, in the preferred embodiment, contains information about the relative accuracy of the estimate). Repeat steps 1–5 until all time indices have been analyzed.
6. Estimate the amplitude/delays: (Select the subset of the N frequencies with corresponding frequency $\omega$ satisfying $|\omega \cdot d_{max}| < \pi$, where $d_{max}$ is the maximum possible source propagation delay between mixture signals. Call this subset $N_\pi$. (Higher frequencies can be used via the appropriate 1/K weighting as described earlier. If the sampling frequency is sufficiently high (see Eq. 11a), all frequencies can be used in the estimation process). Take the modulus of the $x_1(\omega, t)/x_2(\omega, t)$ vector for the $N_\pi$. Frequency $\omega$ satisfying the above bound to obtain amplitude estimates. Divide the natural logarithm of the $x_1(\omega, t)/x_2(\omega, t)$ vector by $j\,\omega$ for the $N_\pi$ frequencies $\omega$ satisfying the above bound to obtain the corresponding delay estimates.
7. Cluster (form histograms) of the weighted estimates (in delay/amplitude space) to determine the number of clusters, C, and the cluster centers. The weighting component calculation is based on the $x_1(\omega, t)/x_2(\omega, t)$ vector, the value of the amplitude/delay estimate, and the frequency specific power vector. Each cluster center will consist of an amplitude, $a_i$ and delay, $d_i$.

Demixing

Figure 9:
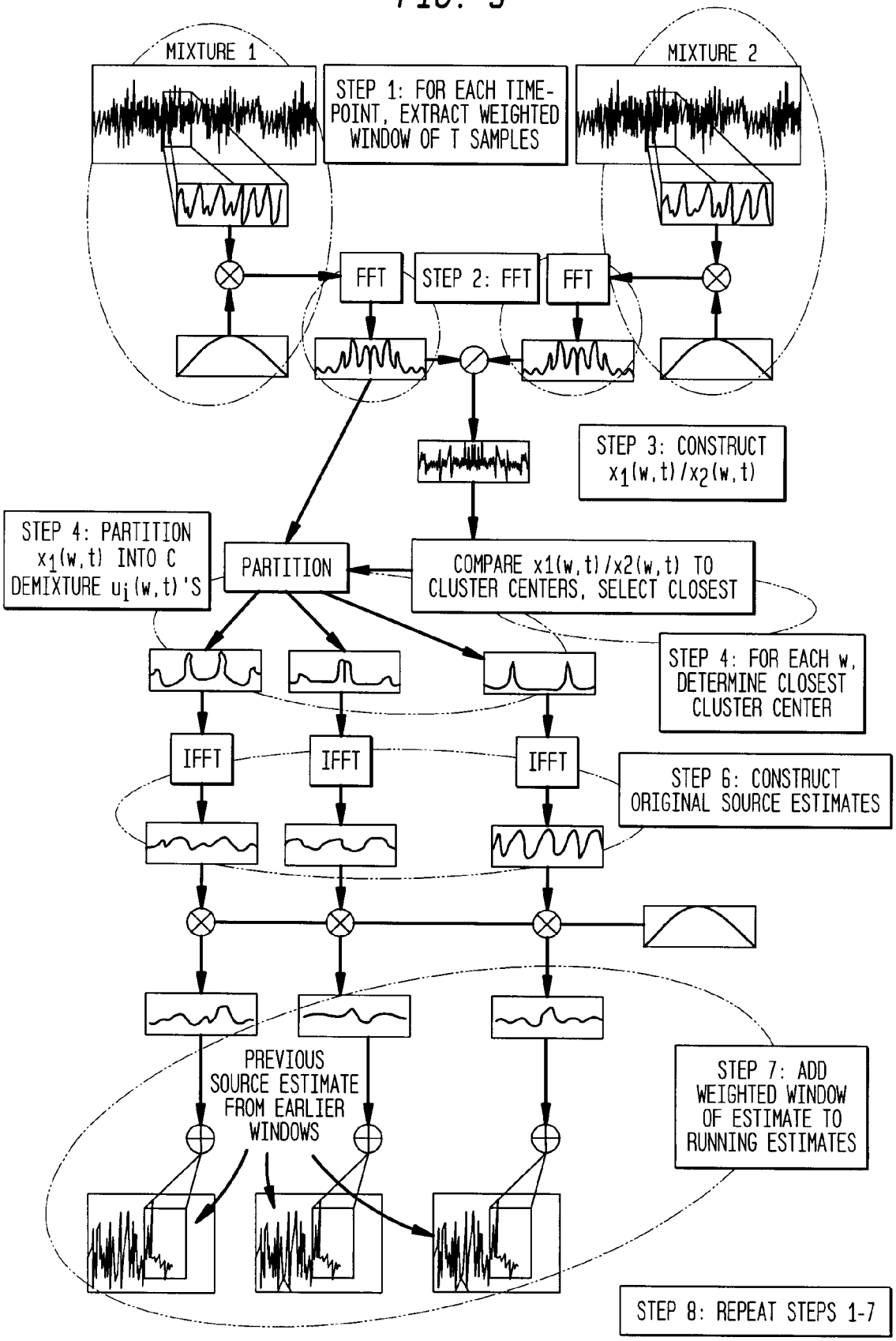
FIG. 9 illustrates demixing in accordance with the principles of the present invention.

Demixing proceeds much in the same way as amplitude/delay estimation. Once the $x_1(\omega)/x_2(\omega)$ vector is obtained for a small time window, the N frequency domain compenents of one of the mixtures ($x_1(\omega)$) are partitioned into the C demixture channels. Each frequency domain component is assigned the channel corresponding to the cluster which its $x_1(\omega)/x_2(\omega)$ maps nearest. Frequency components that do not map close enough to any cluster (i.e., within a given threshold) can be ignored or put on a garbage channel. The frequency domain partitioning is done for overlapping windows, proceeding iteratively through the mixtures, and the Inverse Fast Fourier Transform (IFFT) of each frequency domain channel estimate yields an estimate of a window of the original sources. The overlapping estimates of the original sources are multiplied by a weighting window (e.g., Hamming) and summed to yield the C final source estimates. The demixing algorithm is detailed below and in FIG. 9.

1. For each time point, t, of the mixtures (proceeding iteratively from beginning to end), extract a weighted (e.g., Hamming) window of T samples from each mixture.
2. Take the N point FFT of both windowed mixtures.
3. Divide the N FFT components of the first mixture by the corresponding FFT components of the second mixture; call the resulting vector the $x_1(\omega)/x_2(\omega)$ vector.
4. For each w, calculate which cluster is closest at this ($\omega$, t) pair. We measure closeness as a weighted sum of the amplitude and delay differences. A cluster with center $(a_i, d_i)$ is a distance, $$w_a\left(\left|a_i - \left(\left|\frac{x_2(\omega, t)}{x_1(\omega, t)}\right|\right)\right|\right) + w_d\left(\left|e^{j\omega c d_i} - \left(\left|\frac{x_2(\omega, t)}{x_1(\omega, t)}\right|\right)\frac{x_1(\omega, t)}{x_2(\omega, t)}\right|\right), \quad (12)$$

for amplitude and delay weights $W_a$ and $W_d$.

5. For each ω, set $u_i(\omega,t)=x_i(\omega,t)$ where i is the index of the closest cluster. In other implementations the histogram distribution is modeled with a certain number of parameters and assignment of the values of $x_1(\omega,t)$
6. Take the IFFT of each $u_i(\omega, t)$ (for this t) to obtain estimates of the original sources from time t to t+T
7. Add a weighted (e.g., Hamming) window of the estimates to a running estimate of each source.
8. Repeat steps 1–7 until all time points have been considered.

Thus, there has been shown and described a novel method and apparatus for obtaining real-time estimates of the mixing parameters for mixture signals as well as for real-time unmixing of a desired signal from the mixture signal. Many changes, modifications, variations and other uses and applications of the subject invention will, however, become apparent to those skilled in the art after considering this specification and its accompanying drawings, which disclose a preferred embodiment thereof as well as multiple alternative embodiments. For example, the techniques of the present invention can be applied for many uses, such as in a hearing aid, wired or wireless telephone systems, or speech recognition devices. For example, although in the described embodiment amplitude/delay estimates are determined, other estimates can also be useful, such as relative Doppler shift. All such changes, modifications, variations and other uses and applications which do not depart from the teachings herein are deemed to be covered by this patent, which is limited only by the claims which follow as interpreted in light of the foregoing description.

What is claimed is:

1. A method for blind channel estimation, comprising:

acquiring two mixtures of at least one at least weakly W-disjoint orthogonal source signal;

calculating point-by-point ratios of a transform of a time-window of each of said mixture signals;

determining channel parameter estimates from said ratios;

constructing a histogram of said channel parameter estimates;

repeating the calculating, determining and constructing steps for successive time windows of the mixture signals; and selecting as estimates of said channel parameters those estimates associated with identified peaks on said histogram.

2. The method of claim 1, wherein said transform comprises a Fourier transform.

3. The method of claim 1, further including estimating the number of source signals from the number of peaks in the histogram.

4. The method of claim 1, wherein said channel is an acoustic communications channel.

5. The method of claim 1, wherein said acquiring step uses two microphones in a hearing aid.

6. The method of claim 1, wherein said channel is an EM wireless communications channel.

7. The method of claim 1, wherein said channel parameter is the amplitude.

8. The method of claim 1, wherein said channel parameter is the delay.

9. The method of claim 1, wherein said channel parameter is the amplitude and delay.

10. The method of claim 1, wherein said channel parameter is the direction of arrival.

11. The method of claim 1, wherein said channel parameter is the normalized distance to a source signal.

12. The method of claim 1, wherein said channel estimates are used for constructing a radiation field map.

13. The method of claim 10, wherein said channel estimates are used for constructing a radiation field map.

14. The method of claim 11, wherein said channel estimates are used for constructing a radiation field map.

15. The method of claim 1, wherein the channel parameter is the number of source signals.

16. The method of claim 1, wherein the channel parameter is a reduced attenuation coefficient.

17. The method of claim 1, wherein said channel estimates are used for adaptive antenna beamforming.

18. Apparatus for blind channel estimation, comprising:

two microphones for acquiring two mixtures of at least one at least weakly W-disjoint orthogonal source signal;

transform means for developing a windowed transform for each of said two mixture signals;

a divider for determining point-by-point ratios of said windowed transforms;

a processor for determining channel parameter estimates from said ratios; constructing a histogram of said channel parameter estimates; repeating the calculating, determining, and constructing steps for successive time windows of the mixture signals; and selecting as estimates of said channel parameters those estimates associated with identified peaks on said histogram.

19. A method for demixing of at least weakly W-disjoint orthogonal mixture signals, comprising the steps of:

acquiring one or more channel parameter estimates;

calculating point-by-point ratios of a transform of a time-window of each of said mixture signals;

assigning the value for each point in the transform of a time-window of one of the mixture signals to a first signal source if the estimated channel parameters determined from the ratio are within a given threshold of one of the acquired channel parameter estimates or, if more than one estimate is provided, to the closest of the acquired channel parameter estimates;

repeating the above step for each point in the transform in successive time-windows of the mixture signal;

reconstructing time domain signals from the assigned values of signals by inverse transforming an accumulation of the assigned values for each signal.

20. The method of claim 19, wherein said mixture signals are anechoic time delay mixture signals.

21. The method of claim 19, wherein said mixture signals mixtures contain decorrelated multipath contributions.

22. The method of claim 19, wherein said mixture signals contain weak multipath contributions.

23. The method of claim 19, wherein said mixture signals are acquired in a wireless communications channel.

24. The method of claim 19, wherein said demixing is provided for multi-user detection in a wireless communications system.

25. The method of claim 19, wherein said demixing is provided for background noise reduction in a speech recognition device.

26. The method of claim 19, wherein said demixing is provided for background noise reduction in a cellular telephone.

27. The method of claim 19, wherein said demixing is provided for background noise reduction in a hearing aid.

28. The method of claim 19, wherein said demixing is provided for convolutive mixture signals.

29. The method of claim 28, wherein said demixing is provided for user interference reduction in a wireless communication system.

30. The method of claim 28, wherein said demixing is provided for multi-user detection in a wireless communication system.

31. The method of claim 28, wherein said demixing is provided for background noise reduction in a speech recognition device.

32. The method of claim 28, wherein said demixing is provided for background noise reduction in a cellular telephone system.

33. The method of claim 28, wherein said demixing is provided for background noise reduction in a hearing aid.

34. A method for voice activity detection, comprising the steps of:

setting a voice activity detection flag on;

estimating the number of sources in a sound field map;

demixing the sound source of interest using a weaker assumption on the nature of the signals;

detecting absence of power in said sound source of interest; and setting the voice activity detection flag off.

35. The method of claim 34, wherein said voice activity detection is used in a hearing aid, and said sound source of interest is speech.

36. A method for critical sound activity detection, comprising the steps of:

setting a critical sound activity detector flag off;

computing a sound field map;

estimating the number of sources in said sound field map;

detecting additional sound sources that match one of the critical sounds in their spectral characteristics; and setting critical sound activity flag on.

37. The method of claim 36, wherein said critical sound source of interest is voice sound produced for alert in violation of personal safety in a public or private living area.

38. The method of claim 36, wherein said critical sound source of interest is sound discharged by firearms or other explosive devices in a public or private living area.

* * * * *